US005098093A

United States Patent [19]

Dupré

[11] Patent Number: 5,098,093

[45] Date of Patent: Mar. 24, 1992

[54] MOUNTING FRAME FOR BASKETBALL BACKBOARD

[76] Inventor: Donovan Dupré, 10663 Northbrook, Houston, Tex. 77043

[21] Appl. No.: 525,073

[22] Filed: May 17, 1990

[51] Int. Cl.[5] ..... A63B 63/08

[52] U.S. Cl. ..... 273/1.5 R; 248/237

[58] Field of Search ..... 273/1.5 R; 248/237, 248/148; 40/606, 610

[56] References Cited

U.S. PATENT DOCUMENTS

| | | | |
|---|---|---|---|
| 590,949 | 9/1897 | Wilken | 248/148 |
| 1,650,324 | 11/1927 | Campbell | 248/237 |
| 2,446,093 | 7/1948 | Lambert | 248/237 |
| 3,108,803 | 10/1963 | Naideth | 273/1.5 R |
| 3,414,262 | 12/1968 | Lounsbury | 273/1.5 R |
| 4,085,762 | 4/1978 | O'Brian et al. | 40/610 X |
| 4,613,136 | 9/1986 | Raba et al. | 273/1.5 R |
| 4,869,501 | 9/1989 | Anastasakis | 273/1.5 R |

*Primary Examiner*—Paul E. Shapiro

*Attorney, Agent, or Firm*—Dodge, Bush, Moseley & Riddle

[57] ABSTRACT

A collapsible mounting frame (10) for a basketball backboard (12) has a pair of frame portions (20, 22) adapted for mounting on the sloping roof (16) of a building. Each frame portion (20, 22) has a base member (24), a vertical member (26) connected by a hinge (30) to the base member (24), and a diagonal member (28) connected by hinges (30) to the base member (24) and the vertical member (26). The diagonal member (28) includes a pair of diagonal portions (28A, 28B) adjustably connected to each other to adapt the frame (10) for mounting on roofs (16) having varying slopes.

4 Claims, 1 Drawing Sheet

MOUNTING FRAME FOR BASKETBALL BACKBOARD

BACKGROUND OF THE INVENTION

This invention relates to a mounting frame for a basketball backboard, and more particularly to such a mounting frame adapted for mounting on the roof of a garage or the like to position the basketball backboard at a selected predetermined height above a playing surface.

Heretofore, it has been difficult at times to mount a basketball backboard and hoop from an overhead structure such as a roof of a garage or home adjacent a driveway which provides a playing surface. The height of a roof may vary and the slope of a roof varies. While an upright supporting structure for the basketball backboard may extend from a base on the ground or adjacent the playing surface, such a base or support is expensive and oftentimes difficult to install. Thus, it is desirable to have a backboard supporting frame mounted on a sloping roof adjacent an existing driveway which provides the hard playing surface.

SUMMARY OF THE INVENTION

This invention relates to a supporting frame for a basketball backboard particularly adapted for mounting on the sloping roof of a building, such as a garage or home, adjacent a hard surfaced driveway. The driveway to a garage normally is of a hard surface, such as concrete and the sloping roof of the garage normally provides sufficient height above the driveway for mounting the backboard and hoop at the desired correct height.

The supporting frame may be collapsed to form an easily transportable frame which may be erected and secured to the roof in a minimum of time. The supporting frame includes a pair of similar frame portions each frame portion having three members foldably connected to each other. A first foldable member is a base support member for attachment to the roof. A second foldable member is an upright generally vertically extending member having the backboard adjustably mounted thereon at a selected height above the playing surface, and the third foldable member is an adjustable length diagonal member extending between the base member and vertical member to provide a brace therebetween. The diagonal member comprises two disconnectable portions for adjusting the length of the diagonal member. The backboard upon mounting of the pair of frame portions in spaced parallel relation on the roof is mounted on the two upright members at the desired selected height.

It is an object of this invention to provide a collapsible supporting frame for a basketball backboard with the frame particularly adapted for mounting on a sloping roof of a building, such as a garage, adjacent a driveway providing the playing surface.

Another object of this invention is to provide a collapsible frame which comprises a pair of identical frame portions, each portion including three members foldably connected to each other and erected in supporting relation on a roof in a minimum of time.

Other objects, features, and advantages of this invention will become more apparent after referring to the following specification and drawings.

DESCRIPTION OF THE INVENTION

Figure 1:
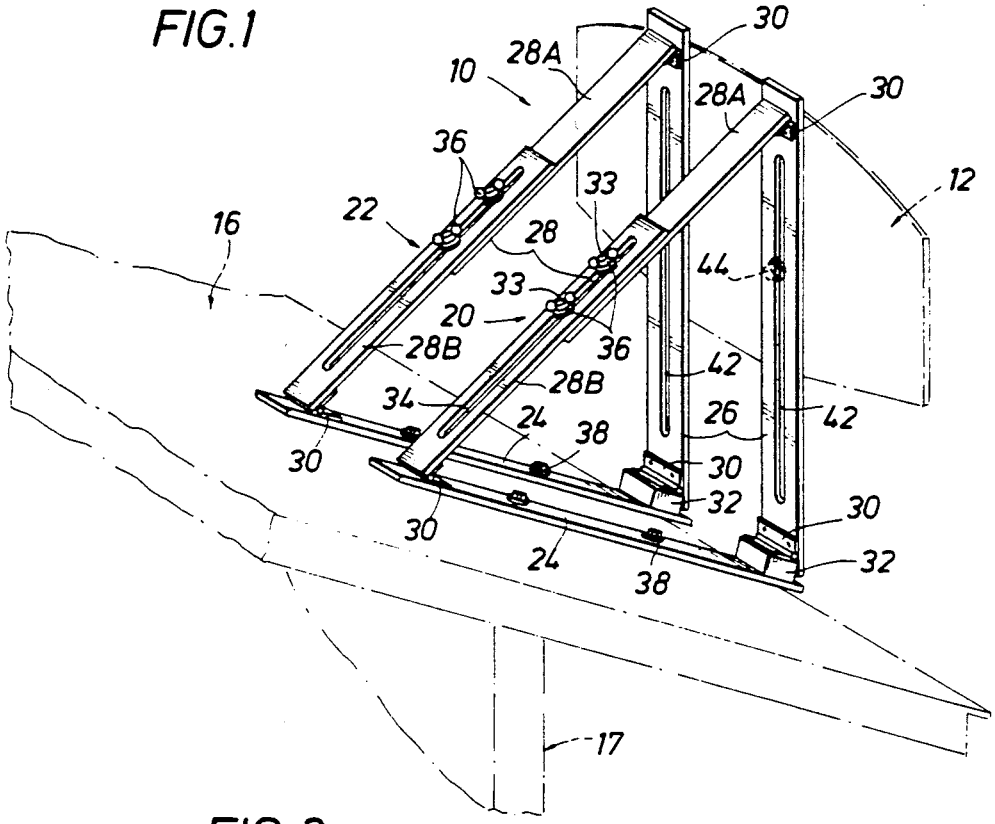
FIG. 1 is a perspective of the support frame for mounting a basketball backboard on a sloping roof of a building with the frame shown in erected position.

Referring to the drawings, a mounting or support frame is generally designated at 10 for supporting a basketball backboard 12 having a hoop 14 secured thereto on a sloping roof generally designated 16 of a building such as a garage 17. A hard surface concrete driveway 18 leading to garage 17 provides a hard playing surface for a basketball player. Backboard 12 is positioned at a location generally above the lower outer edge 19 of roof 16.

Figure 3:
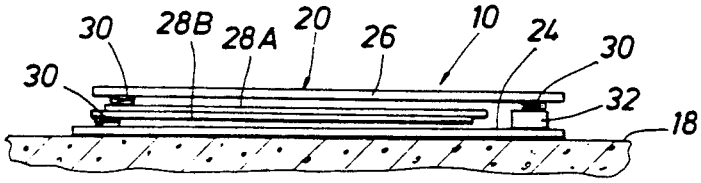
FIG. 3 is a side elevation of a frame portion illustrated in a collapsed position for transport.

Frame 10 includes a pair of similar or identical frame portions 20 and 22 spaced from each in a parallel relation for supporting backboard 12. Each frame portion 20 and 22 includes a first base support member 24, a second vertical upright member 26, and an adjustable diagonal bracing member 28 extending between members 24 and 26. Members 24, 26, and 28 are of a flat rectangular shape and foldably connected to each other by leaf hinges 30. Each flat rectangular member 24, 26 and 28 has a length, a width less than the length, and a thickness less than the width with the length and width defining two opposed flat surfaces separated by the thickness. A mounting block 32 is secured to base member 24 for mounting adjacent hinge 30 thereon and spaces base member 24 from member 26 in folded position to permit diagonal member 28 to fit therebetween in collapsed position to provide a generally uniform thickness of the collapsed frame for shipment as shown in FIG. 3. Diagonal member 28 includes diagonal portions 28A and 28B which are adjustable to vary the length of diagonal member 28 and are hinged respectively to vertical member 26 and base member 24. Upper diagonal member 28A has a pair of threaded bolts 33 extending through suitable openings in member 28A within an elongate slot 34 in diagonal portion 28B and wing nuts 36 are tightened on bolts 33 to position diagonal portions 28A and 28B properly. Suitable washers are provided adjacent diagonal portions 28A and 28B for bolts 33 and wing nuts 36.

Frame portion 20 is shown in FIG. 3 in a collapsed position of a generally rectangular configuration with the opposed flat surfaces of members 24, 26 and 28 being in parallel relation and in this position may be packaged with frame portion 20 and backboard 12 for transport a shipment to a suitable site for erection and installation. At the installation site, frame portion 20 is positioned on sloping roof 16 and suitable openings are drilled through roof 16 on garage 17 for receiving mounting bolts 38. Suitable elastomeric washers or sleeves are positioned about bolts 38 on opposite sides of roof 16 to provide waterproof seals and nuts 40 are then threaded onto bolts 34 from a location underneath roof 16. After securing base member 24, vertical member is folded to a vertical position and bolts 33 and inserted for diagonal portions 28A and 28B. Then, wing nuts 36 are tightened for securing vertical member 26 in vertical position. After installation of frame portion 20 into a triangular configuration formed by connected members 24, 26, and 28 as viewed in side elevation on roof 16, frame portion 22 is installed in a similar manner. Roof 16 may be formed of various materials, such as wooden or composition shingles, for example, secured to a wooden supporting base.

Then, backboard 12 is positioned against vertical members 26 at the desired vertical height and bolts 40 are inserted through suitable openings in backboard 12 and elongate slots 42 in vertical members 26. Nuts 44 are tightened on bolts 40 for securing backboard 12 at the desired height. Hoop 14 may be secured to backboard 12 either before or after the installation of backboard 12.

Figure 2:
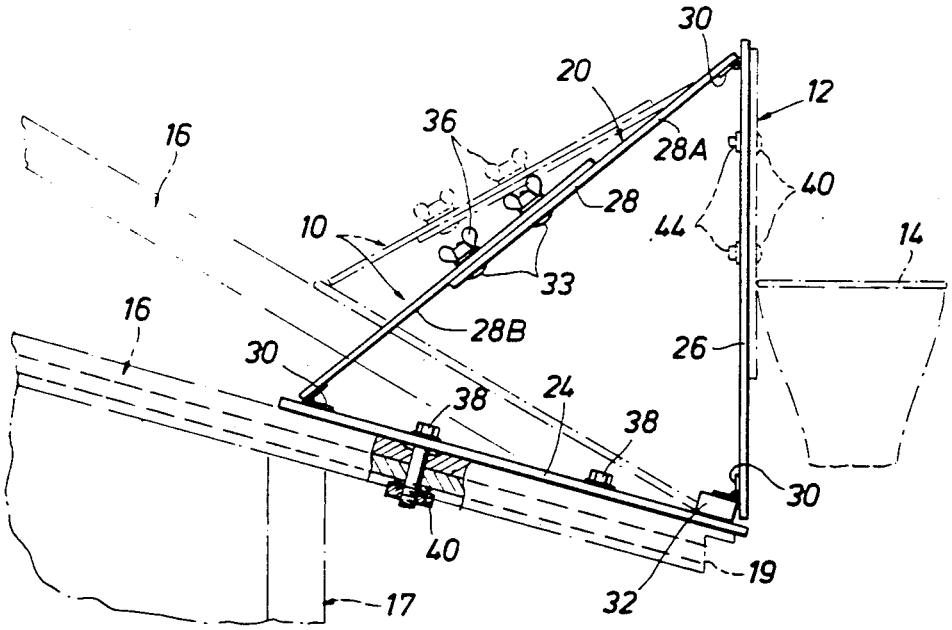
FIG. 2 is a side elevation of the support frame shown in FIG. 2 and showing in broken lines the support frame adapted for use on a roof having a different slope.

From the above, it is apparent that backboard 12 and hoop 14 may be installed on a sloping roof in a minimum of time with a minimum number of tools required. The vertical height of backboard 12 may be easily adjusted as desired. Further, as indicated in broken lines in FIG. 2, frame 10 is easily adapted for use with roofs having varying slopes. Frame 10 may be easily removed from roof 16 in reverse order from the installation procedure.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A collapsible supporting frame for a basketball backboard for mounting on the sloping roof of a building, said supporting frame being installed in erected position on the roof from a collapsed flat position of a generally uniform rectangular cross section for storage and shipment and comprising:

a pair of generally identical frame portions positioned on said sloping roof in parallel spaced relation to each other, each frame portion including a base member secured to said sloping roof, a generally vertical support member pivotably connected to said base member and extending in a generally vertical direction from said sloping roof, and a diagonal member of adjustable length pivotably connected at one lower end to said base member and pivotably connected at its other upper end to said vertical member, each of said frame portions when installed on said roof being of a triangular configuration to form a pair of spaced generally identical unconnected frame portions, each of said members of said frame portions being of a generally flat shape having a length, a width less than said length and a thickness less than said width, said length and width defining two opposed flat surfaces separated by said thickness;

said diagonal member for each frame portion being of an adjustable length and comprising a pair of diagonal portions adjustably connected to each other to adjust the length of said diagonal member;

a hinge between each pair of adjacent members forming each frame portion for pivotably connecting said members to each other, each frame portion being individually collapsible upon disconnection of said diagonal portions from each other for folding said diagonal portions against said base member and said vertical member for subsequent folding of said base and vertical members against each other with said diagonal portions therebetween for providing a collapsed flat position of a generally uniform thickness for storage and shipment;

a separate mounting block between said base member and said vertical support member of each frame portion, said hinge between said base member and said vertical support member being mounted on said mounting block at a height above the base at least twice said thickness for pivotably connecting said base member and said vertical support member, said block spacing said base member and said vertical support member from each other in said collapsed flat position to permit said diagonal portions to fit therebetween, said opposed surfaces of all said members of said frame portion being in generally parallel relation to each other when in a collapsed flat position thereby to provide a collapsed frame portion of a generally uniform thickness for shipment;

a basketball backboard on the vertical member of each frame portion at a position generally adjacent the lower edge of the roof; and vertically adjustable means between said basketball backboard and said vertical members permitting said backboard to be mounted at a predetermined height above a playing surface.

2. The collapsible supporting frame as set forth in claim 1 wherein each of said vertical members has an elongate vertically extending slot therein, and removable fasteners on said backboard extend through said slots for adjustably mounting said backboard on said vertical members.

3. The collapsible supporting frame as set forth in claim 1 wherein one of each pair of diagonal portions has an elongate slot therein and the other associated diagonal portion of each pair has a removable fastener fitting within said elongate slot for adjustable securement therein.

4. The collapsible supporting frame as set forth in claim 1 wherein each of said members forming said frame portions is of a flat rectangular shape.

* * * * *